US009322143B1

(12) United States Patent
Bryan

(10) Patent No.: US 9,322,143 B1
(45) Date of Patent: Apr. 26, 2016

(54) RETAINING WALL CLAMPING ASSEMBLY

(71) Applicant: Desmond D. Bryan, Lake Worth, FL (US)

(72) Inventor: Desmond D. Bryan, Lake Worth, FL (US)

( * ) Notice: Subject to any disclaimer, the term of this patent is extended or adjusted under 35 U.S.C. 154(b) by 4 days.

(21) Appl. No.: 14/248,390

(22) Filed: Apr. 9, 2014

(51) Int. Cl.
*B25B 1/02* (2006.01)
*E02D 5/16* (2006.01)

(52) U.S. Cl.
CPC ..... *E02D 5/16* (2013.01)

(58) Field of Classification Search
CPC ..... E02D 5/16
USPC ..... 269/3, 6, 143, 249; 414/10, 11, 23; 52/148
See application file for complete search history.

(56) References Cited

U.S. PATENT DOCUMENTS

| | | | | |
|---|---|---|---|---|
| 2,929,422 | A | 3/1960 | Tyler et al. | |
| 4,560,192 | A * | 12/1985 | Wilson | E05C 19/004 248/231.71 |
| 4,962,918 | A * | 10/1990 | Yang | 269/156 |
| 6,371,699 | B1 | 4/2002 | Weinreb | |
| 7,604,438 | B2 | 10/2009 | Weyant et al. | |
| 7,985,038 | B2 | 7/2011 | Kwon et al. | |
| 2008/0017783 | A1 | 1/2008 | Vanagan | |
| 2011/0091303 | A1* | 4/2011 | Matthews | 414/11 |
| 2011/0170958 | A1 | 7/2011 | Taylor | |

* cited by examiner

*Primary Examiner* — Shelley Self
*Assistant Examiner* — Nirvana Deonauth

(57) ABSTRACT

A retaining wall clamping assembly facilitates bracing of a temporary retaining wall. The assembly includes a bar having a first section coupled to a second section. The first section is selectively extendable and retractable relative to the second section. Each of a pair of jaws extends from an associated one of the first section and the second section. The jaws are aligned defining a clamp for engaging a retaining wall. A bracing aperture extends through the bar for coupling a brace to the bar by a connector inserted through the bracing aperture to support the retaining wall in an upright position.

1 Claim, 4 Drawing Sheets

RETAINING WALL CLAMPING ASSEMBLY

BACKGROUND OF THE DISCLOSURE

Field of the Disclosure

The disclosure relates to clamping devices and more particularly pertains to a new clamping device for facilitating bracing of a temporary retaining wall.

SUMMARY OF THE DISCLOSURE

An embodiment of the disclosure meets the needs presented above by generally comprising a bar having a first section coupled to a second section. The first section is selectively extendable and retractable relative to the second section. Each of a pair of jaws extends from an associated one of the first section and the second section. The jaws are aligned defining a clamp for engaging a retaining wall. A bracing aperture extends through the bar for coupling a brace to the bar by a connector inserted through the bracing aperture to support the retaining wall in an upright position.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
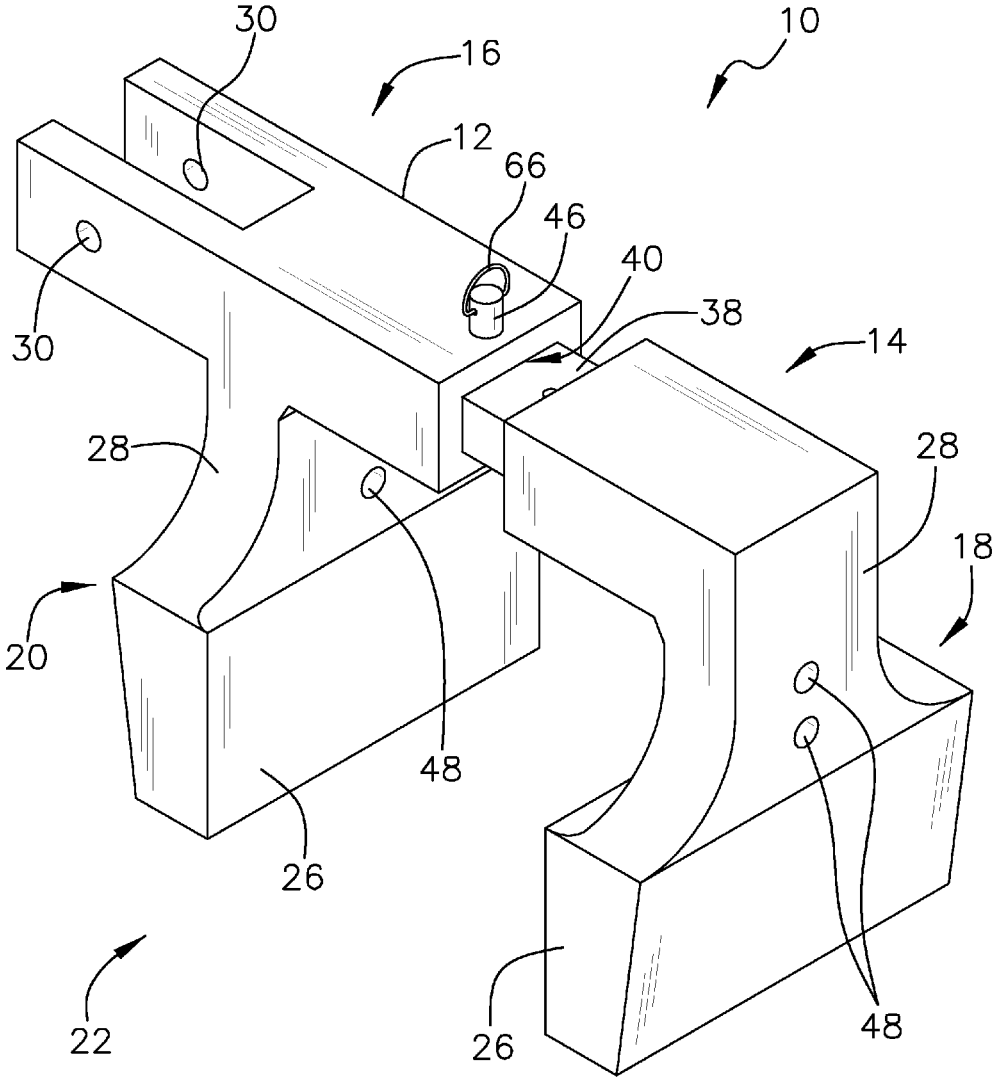
FIG. 1 is a top front side perspective view of a retaining wall clamping assembly according to an embodiment of the disclosure.
Figure 2:
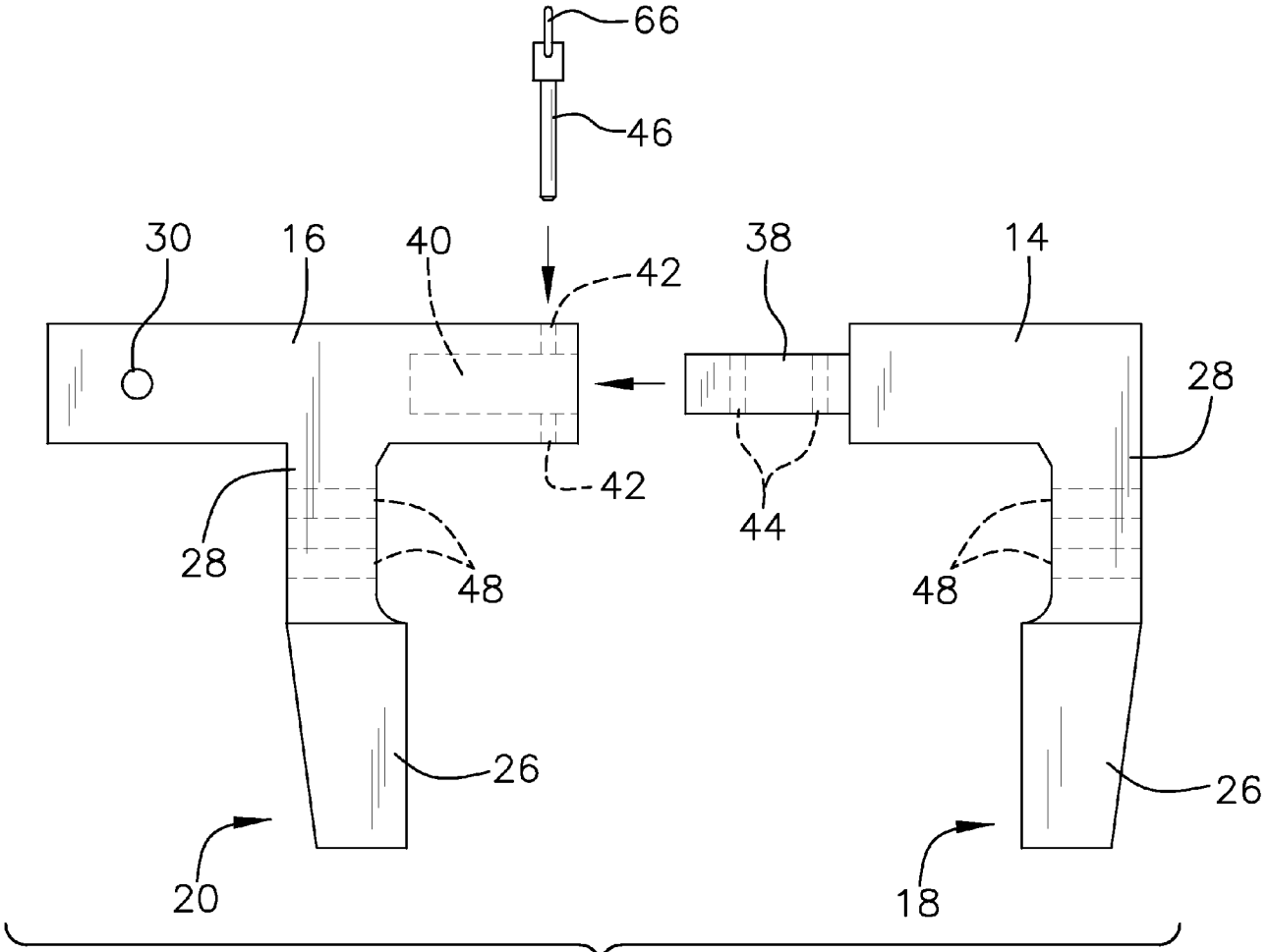
FIG. 2 is an exploded side view of an embodiment of the disclosure.
Figure 3:
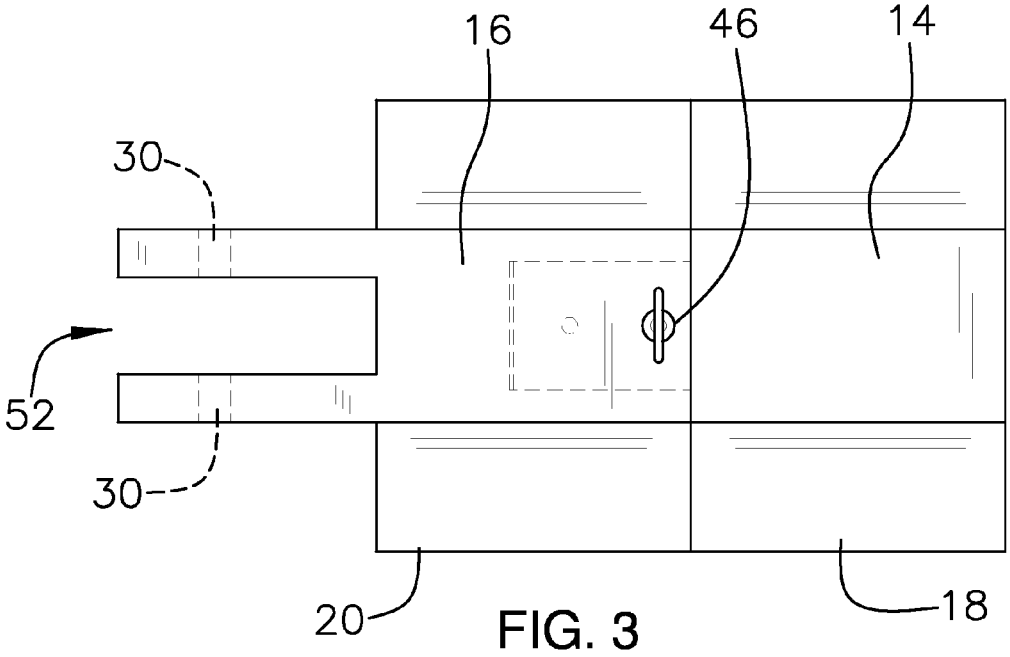
FIG. 3 is a top view of an embodiment of the disclosure.
Figure 4:
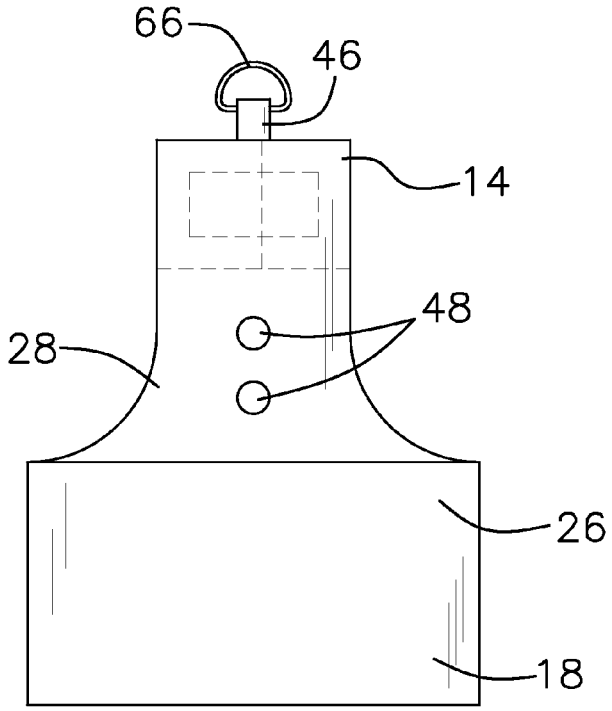
FIG. 4 is a front view of an embodiment of the disclosure.
Figure 5:
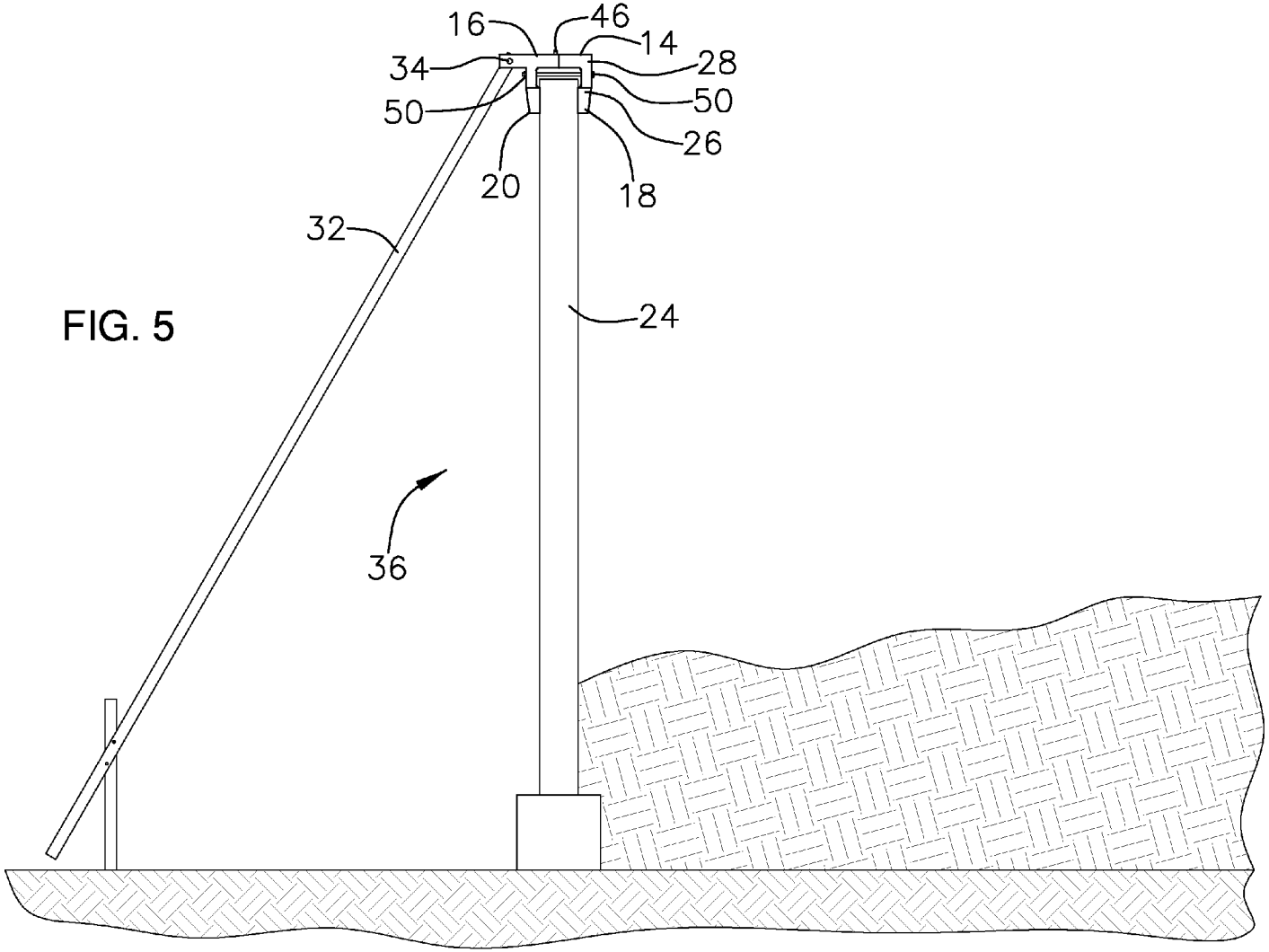
FIG. 5 is a side view of an embodiment of the disclosure in use.

With reference now to the drawings, and in particular to FIGS. 1 through 5 thereof, a new clamping device embodying the principles and concepts of an embodiment of the disclosure and generally designated by the reference numeral 10 will be described.

As best illustrated in FIGS. 1 through 5, the retaining wall clamping assembly 10 generally comprises a bar 12 having a first section 14 coupled to a second section 16. The first section 14 is selectively extendable and retractable relative to the second section 16. Each of a pair of jaws 18,20 extends from an associated one of the first section 14 and the second section 16. The jaws 18,20 are aligned such that the jaws 18,20 define a clamp 22 configured for engaging a retaining wall 24. Each jaw 18,20 has a clamping section 26 and a neck section 28. The neck section 28 extends between the clamping section 26 and the bar 12. A bracing aperture 30 extends through the bar 12. Thus, the bar 12 is configured for being coupled to a brace 32 by a connector 34 inserted through the bracing aperture 30 wherein the retaining wall 24 is supported in an upright position 36 by the brace 32.

A tongue 38 extends from the first section 14 of the bar 12. A socket 40 extends into the second section 16 of the bar 12. The tongue 38 is slidably insertable into the socket 40 to permit expansion and retraction of the jaws 18,20. A pair of holes 42 extends through the second section 16. The holes 42 are aligned across the socket 40. A plurality of spaced locking apertures 44 extend through the tongue 38. Each locking aperture 44 is selectively alignable with the aligned holes 42. A locking pin 46 is insertable through the aligned holes 42 and a selected one of the locking apertures 44 wherein the first section 14 of the bar 12 is secured in a fixed position relative to the second section 16 of the bar 12. A ring 66 may be coupled to the locking pin 46 to facilitate removal of the locking pin 46 when desired. Each of a plurality of tightening apertures 48 extends through an associated neck section 26 of a respective one of the jaws 18,20. Associated pairs of the tightening apertures 48 are aligned. A tightening member 50 is inserted through the associated pair of tightening apertures 48. The tightening member 50 is adjustable for urging the jaws 18,20 together such that the clamping sections 28 of the jaws 18,20 frictionally engage the retaining wall 24. The jaws 18,20 may be constructed of a resilient plastic material wherein the jaws 18,20 are pivoted relative to the bar 12 as the tightening member 50 is tightened.

A slit 52 may extend into the second section 16 of the bar 12. The bracing aperture 30 may be split by the slit 52 forming a pair of bracing apertures 30 aligned across the slit 52. Thus, the bar 12 may be configured for receiving the brace 32 into the slit 52 aligning the brace 32 with the bar 12.

In use, the bar 12 is coupled to the retaining wall 24 by setting the tongue 38 in the socket 40 at a selected position. One or more tightening members 50 are inserted through the aligned pairs of tightening apertures 48 and adjusted firmly clamp the jaws 18,20 to the retaining wall 24. The brace 32 is coupled to the bar 12 in a position to support the retaining wall 24 in the upright position 36. Thus, the retaining wall 24 may be temporarily supported by the assembly 10 prior to more permanent setting of the retaining wall 24.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A retaining wall clamping assembly comprising:

a bar having a first section coupled to a second section, said first section being selectively extendable and retractable relative to said second section;

a pair of jaws, each jaw extending from an associated one of said first section and said second section, said jaws being aligned wherein said jaws define a clamp configured for engaging a retaining wall, each jaw having a clamping section and a neck section, said neck section extending between said clamping section and said bar;

a bracing aperture extending through said bar wherein said bar is configured for being coupled to a brace by a connector inserted through said bracing aperture wherein the retaining wall is supported in an upright position by the brace;

a tongue extending from said first section of said bar;

a socket extending into said second section of said bar, said tongue being slidably insertable into said socket;

a pair of holes extending through said second section, said holes being aligned across said socket;

a plurality of spaced locking apertures extending through said tongue, each said locking aperture being selectively alignable with said aligned holes;

a locking pin insertable through said aligned holes and a selected one of said locking apertures wherein said first section of said bar is secured in a fixed position relative to said second section of said bar;

a plurality of tightening apertures, each tightening apertures extending through an associated said neck section, associated pairs of said tightening apertures being alignable;

a tightening member inserted through said associated pair of tightening apertures, said tightening member being adjustable for urging said jaws together such that said clamping sections of said jaws frictionally engage the retaining wall, said jaws being constructed of a resilient plastic material wherein said jaws are pivoted relative to said bar as said tightening member is tightened; and a slit extending into said second section of said bar, said bracing aperture being one of a pair of bracing apertures being aligned across said slit wherein said bar is configured for receiving the brace into said slit.

* * * * *